US006089069A

United States Patent [19]

Seidel et al.

[11] Patent Number: 6,089,069

[45] Date of Patent: Jul. 18, 2000

[54] APPARATUS AND METHOD FOR INFLUENCING THE FRICTIONAL CONDITIONS BETWEEN AND UPPER ROLL AND A LOWER ROLL OF A ROLL STAND

[75] Inventors: Jürgen Seidel, Kreuztal, Germany; Hans-Heinrich Hartmann, Chonburi, Thailand

[73] Assignee: SMS Schloemann-Siemag Aktiengesellschaft, Düsseldorf, Germany

[21] Appl. No.: 09/167,366

[22] Filed: Oct. 7, 1998

[30] Foreign Application Priority Data

Oct. 9, 1997 [DE] Germany ..... 197 44 503

[51] Int. Cl.[7] ..... B21B 27/06

[52] U.S. Cl. ..... 72/236; 72/201; 72/10.2

[58] Field of Search ..... 72/10.1, 10.2, 72/10.3, 201, 236, 13.4, 13.5, 13.6, 200, 365.2

[56] References Cited

U.S. PATENT DOCUMENTS

| | | | |
|---|---|---|---|
| 4,385,511 | 5/1983 | Vydrin | 72/205 |
| 4,566,299 | 1/1986 | Koyama et al. | 72/10.2 |
| 5,517,842 | 5/1996 | Ginzburg | 72/201 |
| 5,768,927 | 6/1998 | Kajiwara et al. | 72/10.1 |
| 5,806,357 | 9/1998 | Bouchillon et al. | 72/10.3 |

FOREIGN PATENT DOCUMENTS

| | | | |
|---|---|---|---|
| 59-174213 | 10/1984 | Japan | 72/10.1 |

*Primary Examiner*—Ed Tolan

*Attorney, Agent, or Firm*—Friedrich Kueffner

[57] ABSTRACT

An apparatus and a method for influencing the frictional conditions between an upper roll and a lower roll of a roll stand of a hot-rolling train for wide strip or a cold-rolling train for strip. The apparatus includes a spraying device arranged at the entry side of the roll stand for spraying a defined quantity of liquid in the direction of the roll gap and a control device for determining the quantity and discharge of this liquid, wherein used as a control variable is a predetermined or also computed variable in connection with the actual roll torque of the lower roll or/and the upper roll.

10 Claims, 2 Drawing Sheets

APPARATUS AND METHOD FOR INFLUENCING THE FRICTIONAL CONDITIONS BETWEEN AND UPPER ROLL AND A LOWER ROLL OF A ROLL STAND

BACKGROUND OF THE INVENTION

1. Field of the Invention

The present invention relates to an apparatus for influencing the frictional conditions between an upper roll and a lower roll of a roll stand of a hot-rolling train for wide strip or a cold-rolling train for strip.

The present invention also relates to a method for rolling a rolling material by influencing the frictional conditions between an upper roll and a lower roll of a roll stand.

2. Description of the Related Art

It has been found in practice that during the rolling operation the torques significantly vary between the upper roll and the lower roll of a roll stand of a hot rolling train for wide strip or a cold rolling for strip. Torque differences between the upper and lower rolls in the order of magnitude of between 30% and 70% are not infrequent.

The reason for these differences are the different frictional conditions in the roll gap, i.e., between the upper roll and the upper strip surface of the rolling stock as well as between the lower roll and the lower strip surface of the rolling stock. The effect of these frictional conditions is that different torque requirements prevail at the upper roll and the lower roll. In addition, these different frictional conditions are also influenced by the so-called angle of contact of the hot or cold strip around the upper roll and the lower roll caused by loop lifting devices or guide rolls.

Different frictional conditions in the roll gap and the resulting uneven distribution of the torque requirements of the upper roll and the lower roll not only influence the configuration of the participating components, such as drive spindles, gear assemblies, etc., but they also constitute an impairment of the strip surface quality, of the duration of use of the rolls between roll changes, and of the service life of the rolls caused by increased wear.

Because of the different frictional conditions, it is also not possible to carry out uniformly distributed pass reductions of the hot or cold strip between the upper roll and the lower roll. Since the resistance of the rolling stock against deformation is a combination of the actual resistance to deformation of the material and of the resistance to flow between the roll and the rolling stock, more material is deformed in the case of a low resistance to flow than in the case of a higher resistance to flow; this means that the decrease or the elongation of the rolling stock is greater in that portion of roll gap which has the lower friction value and, thus, the lower resistance to flow of the rolling stock. This, in turn, has the result that the rolling stock has different qualities over its length, and, therefore, frequently does not meet quality requirements.

The pass reduction leads to stretching which means that the rolling stock is elongated. In the entry area of the roll stand, the rolling stock arrives at the two rolls at the upper side as well as on the bottom side of the strip with the same entry speed. Consequently, the rolling stock is essentially forced to leave the rolls with the same speed at the upper side as well as at the lower side of the strip. However, this requires that the friction values between the upper roll and the upper surface of the strip as well as the friction values between the lower roll and the bottom side of the strip are equal. However, as already described above, different friction values occur in practical operation, so that the rolling stock slides between the rolls. This additional relative movement between rolls and rolling stock caused by the different frictional conditions can be recognized by the pattern of wear of the roll surfaces. In addition, the additional relative movement can be recognized by a ski-like shaping of the strip beginning, i.e., after leaving the stand, the strip is bent upwardly or downwardly. In either case, these relative movements occur in addition to the flow of the rolling stock during the deformation, wherein these relative movements impair the efficiency of the rolling process and, thus, not only increase the energy requirement and the wear of the rolls, but they also significantly impair the surface quality of the strip.

SUMMARY OF THE INVENTION

Therefore, it is the primary object of the present invention to provide an apparatus which makes it possible that virtually the same frictional conditions are produced between the upper strip surface of the upper roll as well as between the lower strip surface of the rolling stock and the lower roll, so that the efficiency of the rolling process is improved and the wear of the upper and lower rolls is reduced; in addition, it is an object of the present invention to dampen the tendency to vibrations which frequently occur in the case of greater thickness reductions.

In accordance with the present invention, an apparatus is provided which includes a spraying device arranged at the entry side of the roll stand for spraying a defined quantity of liquid in the direction of the roll gap and a control device for determining the quantity and discharge of this liquid, wherein used as a control variable is a predetermined or also computed variable in connection with the actual roll torque of the lower roll or/and the upper roll.

The method according to the present invention for rolling the rolling stock by influencing the frictional conditions between an upper roll and a lower roll of a roll stand provides wetting the upper strip surface and/or the lower strip surface of the rolling stock on the entry side of the roll stand by a spraying device with a defined quantity of liquid, wherein a control device controls the determination of the quantity and the discharge of the liquid, and wherein used as a control variable is a predetermined or computed variable in connection with the actual roll torque of the lower and/or upper roll.

For this purpose, the spraying device preferably is composed of an upper spray pipe and a lower spray pipe at the entry side of the stand in the vicinity of the roll gap in the area of the upper or lower rolls. The spray pipes themselves have preferably uniformly distributed or, for example, parabolically distributed nozzles whose jet direction is aimed directed into the roll gap. The equalization of the frictional conditions between the upper and the lower rolls relative to the rolling stock is achieved by changing the quantity of the liquid, preferably water or a water/oil mixture which is sprayed into the area of the roll gap.

The quantity of liquid which is sprayed in the direction of the roll gap is determined by a control device. This control device is also intended to control the effect of the two spray pipes independently of each other, i.e., so that, for example, less liquid is supplied to the upper spray pipe and more liquid is supplied to the lower spray pipe. This control device further includes measurement pickups, which especially determine the actually occurring torques at the upper roll and the lower roll of the roll stand. The torque difference which is computed from these two determined torque values is then proportional to the discharged quantity of liquid. Consequently, this quantity of liquid must be selected in such a way that, on the one hand, cooling of the upper strip surface and of the lower strip surface does not exceed an impermissible limit and, on the other hand, a sufficient control range is available for adjusting the frictional conditions in the roll gap.

The determination of the torque preferably is effected by measurement pickups arranged at the drive spindles of the rolls. When the rolls are driven with separate drives for the upper roll and the lower roll, such a separate measurement pickup arrangement is not necessary because the current consumption of the drive motors can be used for the control because it is proportional to the actual torque.

The control device further includes control valves which are adjusted in accordance with the predetermined or computed torque values. Preferably two control valves are provided, wherein the first control valve is provided for the discharged quantity of water and the second control valve is provided for the discharged quantity of oil. Depending on the positions of the control valves, different mixtures of water and oil produce different effects on the rolls and, thus, different changes of the frictional values between the upper side of the strip and the upper roll and between the lower side of the strip and the lower roll. The algebraic sign of the respective torque difference of the deviation from a defined intended torque difference represents the signal for the direction in which the valve must be adjusted.

It is also possible to use only one valve as control valve. The other control valve is then fixed in a defined basic position which is approximately in the middle of the range which provides the controllable valve for the rolling program with a sufficient controlling range in both directions. The position of the valve can be adapted to the respective rolling program. However, it is also possible to adjust the valves for the upper spray pipe and for the lower spray pipe from a basic position into opposite directions in order to utilize the maximum possible control range.

In accordance with another feature of the present invention, the composition of the water/oil mixture for the roll gap lubrication is included in the control. In the same manner as the difference of the respective torques at the drive spindles of the rolls is utilized for controlling one of the two valves for the spray pipes, the sum of the torques at the spindles can be measured and the minimum thereof can be utilized as a signal for optimizing the composition of the water/oil mixture.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 2:
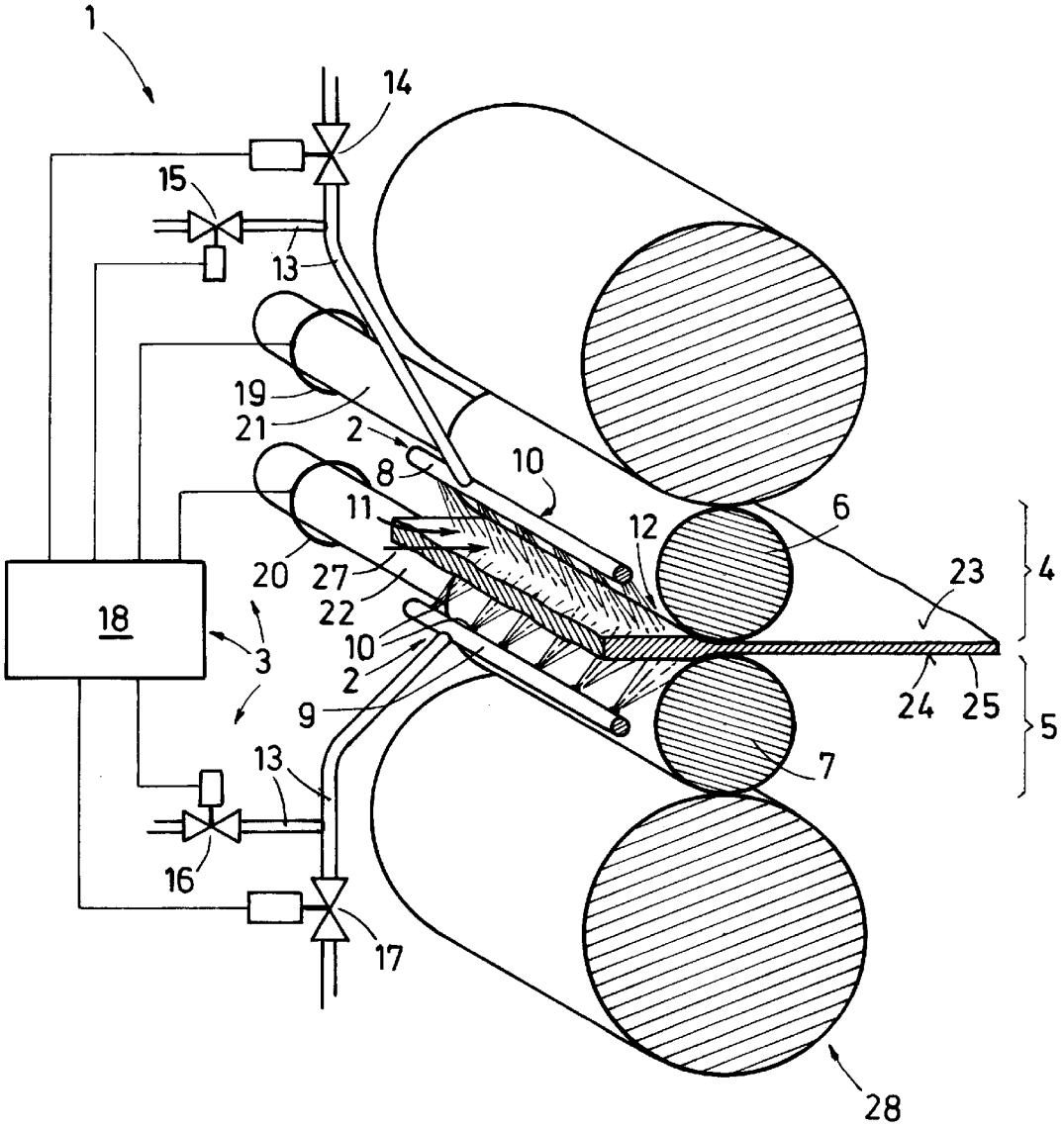
FIG. 2 is a schematic perspective view of the apparatus including the control device.

As illustrated in FIG. 2, the apparatus according to the present invention includes a spraying device 2 and a control device 3 coupled to the spraying device 2. The spraying device 2 includes spraying pipes 8, 9 extending parallel to the roll axes and arranged in the areas 4 and 5 of the upper roll 6 and the lower roll 7. The spraying pipes 8, 9 have nozzles 10 arranged on the circumference in such a way that a water or water/oil mixture flow conducted through the pipes is deflected by the nozzles 10 in the direction of the arrow 11 toward the roll gap 12.

Figure 1:
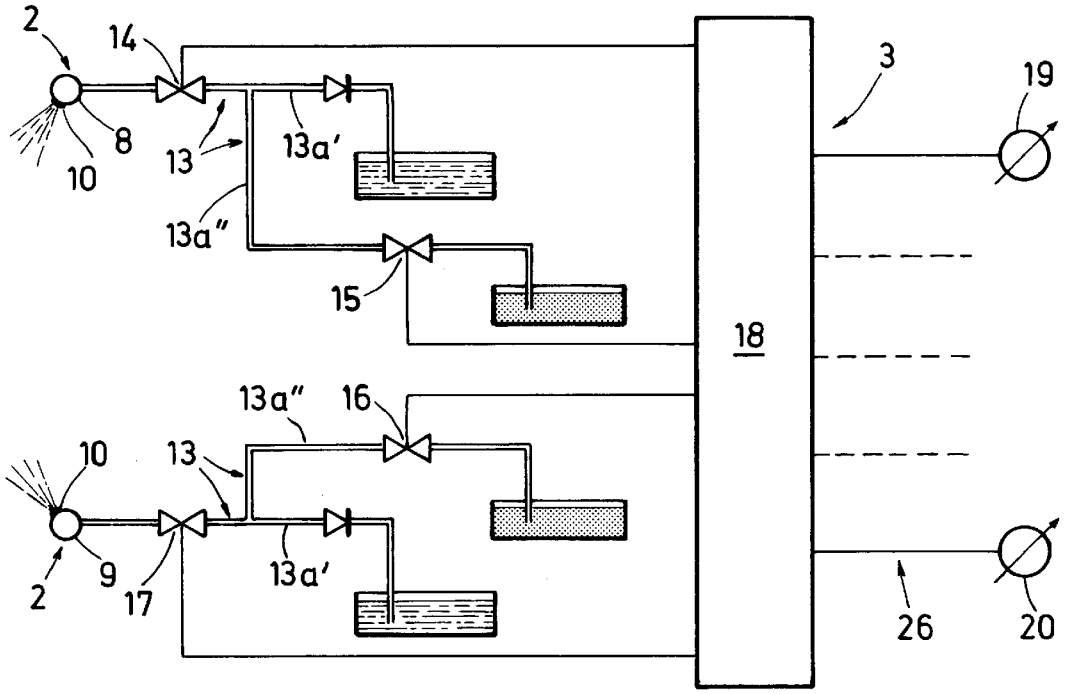
FIG. 1 is a schematic diagram showing the control of the apparatus.

The spraying pipes 8, 9 are connected to a pipe system 13. In the embodiment illustrated in FIG. 1, leading to each pipe 13*a* are two pipes, wherein a first pipe 13*a′* is intended to conduct water and a second pipe 13*a″* is intended for conducting oil. Both pipes 13*a′* and 13*a″* are combined prior to leading into the spraying pipes 8, 9 and, thus, make available the water/oil mixture intended for reducing the frictional value. Both pipes 13*a′* and 13*a″* each have valves 14, 15 and 16, 17, respectively, which are connected to the control unit 18 of the control device 3.

The control device 3 processes the information provided by the measurement pickups 19, 20, wherein additional measurement pickups are indicated by broken lines. These measurement pickups are arranged, for example, at the drive spindle 21, shown in FIG. 2, for measuring the actual torque. The control device 3 controls the control valves 14, 15, 16, 17 in such a way that a computed quantity of liquid reaches the area of the roll gap 12 and to ensure that equal frictional conditions are achieved in the roll gap between the upper side 23 of the strip 25 and the upper roll 6 and between the lower side 24 of the strip 25 and the lower roll 7.

As illustrated in FIG. 2, the upper roll 6 and the lower roll 7 are driven by principal drive spindles 21 and 22, respectively.

In the case of separate drives of the upper and lower rolls 6 and 7, the measurement devices at the drive spindles are not required because the current consumption of the individual drive motors is measured for controlling purposes.

In accordance with an embodiment not illustrated in the drawing, a control valve is controlled by the control units while the position of the other control valve is adjusted to the respective rolling program by a superimposed computing system. It is also conceivable in this connection that the control unit controls the other control valve and the superimposed computing system controls the first control valve. However, since the liquid requirement for the lower roll is usually always greater than for the upper roll because liquid collects on the upper side of the strip which emanates from the roll cooling device for the upper roll and which drips laterally at the stripping members onto the strip surface, so that, when the other valve is controlled, too much water collects on the strip surface. The other valve would then be controlled in order to compensate in such a way that the effect of the sufficiently existing liquid on the upper surface of the strip would be compensated by adding more water to the lower side of the strip. Once the lower water quantity for the respective rolling program has been fixedly adjusted, the liquid flowing in an uncontrolled manner onto the upper side of the strip is included into the control. In cases in which the control of both control valves takes place in the opposite directions, the basic liquid quantity in the middle of the control range is determined for both control valves by the computing system.

In some rolling programs it is an additional advantage for reducing the roll wear when a specific quantity of a special rolling oil is mixed into the liquid to be sprayed into the roll gap. The correct mixing ratio is empirically determined. When rolling oil is used in this manner, it is advantageous in the case of a changed spray quantity to keep the mixing ratio constant by means of the respective control valve for oil.

While specific embodiments of the invention have been shown and described in detail to illustrate the inventive principles, it will be understood that the invention may be embodied otherwise without departing from such principles.

We claim:

1. An apparatus for influencing frictional conditions between strip and an upper roll and a lower roll of a roll stand of a hot rolling train for wide strip or a cold rolling train for strip, the apparatus comprising a spraying device arranged at an entry side of the roll stand for spraying a quantity of liquid each onto an upper side of the strip and onto a lower side of the strip and a control device for determining the quantity sprayed onto the upper side and the quantity of liquid sprayed onto the lower side in dependence on actual roll torques of at least one of the lower roll and the upper roll.

2. The apparatus according to claim 1, wherein the liquid is water.

3. The apparatus according to claim 1, wherein the liquid is a water/oil mixture.

4. The apparatus according to claim 1, wherein the liquid additionally contains rolling oil.

5. The apparatus according to claim 1, wherein the liquid contains lubricating agent, wherein a lubricating agent used on an upper side of the strip has different frictional properties than a lubricating agent used on a lower side of the strip.

6. The apparatus according to claim 1, wherein the spraying device comprises at least one spraying pipe mounted in an area of the rolls.

7. The apparatus according to claim 6, wherein the spraying pipe comprises nozzles which in the mounted state of the spraying device are directed toward the rolls.

8. The apparatus according to claim 6, wherein the spraying pipe comprises nozzles which in the mounted state of the spraying device are directed into the roll gap.

9. The apparatus according to claim 6, wherein the spraying pipe comprises nozzles which in the mounted state of the spraying device are directed onto the rolling stock.

10. A method of rolling strip-shaped rolling stock by influencing frictional conditions between the rolling stock and an upper roll and a lower roll of a roll stand, the method comprising an upper side of the strip and a lower side of the strip each at an entry side of the roll stand by a spraying device with a quantity of liquid, and controlling the quantity of the liquid sprayed onto the upper side and the quantity of liquid sprayed onto the lower side in dependence on actual roll torques of the lower and upper rolls.

* * * * *